US008939199B2

(12) United States Patent
Gipson

(10) Patent No.: US 8,939,199 B2
(45) Date of Patent: Jan. 27, 2015

(54) SYSTEM FOR REPOSITIONING A COILED TUBING TENSIONER

(75) Inventor: Tommie C. Gipson, Eaton, CO (US)

(73) Assignee: RRI Holdings, Inc., Dallas, TX (US)

( * ) Notice: Subject to any disclaimer, the term of this patent is extended or adjusted under 35 U.S.C. 154(b) by 528 days.

(21) Appl. No.: 13/506,005

(22) Filed: Mar. 20, 2012

(65) Prior Publication Data

US 2013/0121801 A1 May 16, 2013

Related U.S. Application Data

(60) Provisional application No. 61/629,243, filed on Nov. 15, 2011.

(51) Int. Cl.
*E21B 19/22* (2006.01)

(52) U.S. Cl.
CPC ..... *E21B 19/22* (2013.01)
USPC ..... 166/77.2; 166/381; 166/77.1

(58) Field of Classification Search
USPC ..... 166/77.1–77.3
See application file for complete search history.

(56) References Cited

U.S. PATENT DOCUMENTS 4,673,035 A * 6/1987 Gipson ..... 166/77.1
6,502,641 B1 * 1/2003 Carriere et al. ..... 166/384
7,152,672 B1 * 12/2006 Gipson ..... 166/77.2
7,708,058 B1 5/2010 Gipson

* cited by examiner

*Primary Examiner* — Giovanna Wright
(74) *Attorney, Agent, or Firm* — Elizabeth R. Hall

(57) ABSTRACT

A system for positioning a trailer mounted coiled tubing tensioner either in a first stowed position on the deck of a transport trailer or in a second position resting on an elevated rig floor of a drilling rig is described. The system for selectably elevating a coiled tubing tensioner from its first stowed position to its second position on the rig floor of a drilling rig includes the cooperative operation of the coiled tubing tensioner and its frame, multiple pivotable swing arms attached to the trailer at one end and the tensioner frame at the other end, an elevatable mast, a crown block, a drawworks winch, a top drive, a pair of tensioner lifting winches and multiple lifting lines deployed from the mast and reeved through sheaves mounted on the tensioner frame and the top drive.

21 Claims, 10 Drawing Sheets

SYSTEM FOR REPOSITIONING A COILED TUBING TENSIONER

CROSS-REFERENCE TO RELATED APPLICATION

The present application, pursuant to 35 U.S.C. 111(b), claims the benefit of the earlier filing date of provisional application Ser. No. 61/629,243 filed Nov. 15, 2011, and entitled "Combination Drilling Rig."

BACKGROUND OF THE INVENTION

1. Field of the Invention

The present invention relates to a system for selectably elevating a coiled tubing injector or tensioner from a first stowed position on the deck of a transport trailer or in a second position resting on an elevated rig floor of a drilling rig. The system uses lifting lines from the mast to raise the coiled tubing tensioner from the first position to the second position.

2. Description of the Related Art

Coiled tubing rigs primarily include a tubing storage reel and a coiled tubing injector or tensioner for forcing a string of coiled tubing into or pulling it out of a well. Coiled tubing rigs are commonly used in the oilfield for reasons of speed and low cost operation.

Due to advances in the ability to run downhole drilling motors on the lower end of a coiled tubing drill string, a need has arisen for coiled tubing injectors or tensioners which can be positioned on a rig floor so that the tubing from the injector is coaxially aligned with the well bore. Previously, this need has been filled by lifting a self-contained conventional tensioner from a transport trailer to the rig floor using large forklift trucks, cranes, or other means. Upon completion of a job by such a tensioner, the tensioner has to be lifted back onto the transport trailer.

Alternatively, as described in U.S. Pat. No. 7,708,058, the tensioner may be lifted from a trailer to the drilling rig floor with the use of large hydraulic cylinders.

When being transported, such a conventional tensioner must be restrained by tiedown means, so the conventional approach involves considerable setup and rig down time, as well as necessitating lifting equipment. Additionally, the storage reel must be carefully positioned during the lifting to and from the rig floor in order to avoid damaging the tubing, particularly when the tubing is left engaged with the injector. If the tubing is released from the injector for lifting, then it must be rethreaded through the injector after the injector has been lifted.

Accordingly, a need exists for a system to readily reposition a coiled tubing injector or tensioner between a transport trailer and a rig floor.

SUMMARY OF THE INVENTION

The present invention relates to a system for positioning a trailer mounted coiled tubing tensioner either in a first stowed position on the deck of the transport trailer or in a second position resting on an elevated rig floor of a drilling rig.

One embodiment of the present invention includes a system for positioning a coiled tubing tensioner, the system comprising: (a) a coiled tubing tensioner wheel mounting a coiled tubing hold-down assembly; (b) a tensioner frame rotatably mounting the coiled tubing tensioner wheel, a plurality of pivotable swing arms, and a pair of tensioner frame lifting sheaves; (c) an elevatable mast mounting a crown block, a drawworks winch, and a pair of tensioner lifting winches; (d) a plurality of top drive lifting lines, each line having a first end attached to the drawworks winch and a second end attached to a top drive and wherein the top drive lifting lines pass over the crown block; and (e) a pair of tensioner lifting lines, wherein each tensioner lifting line has a first end attached to one of the tensioner lifting winches and a second end attached to the top drive, wherein each tensioner lifting line has a length sufficient to be reeved through one of the tensioner frame lifting sheaves and a tensioner lift line turning sheave mounted on the top drive.

Another embodiment of the present invention includes a system for positioning a coiled tubing tensioner, the system comprising: (a) a coiled tubing tensioner wheel mounting a coiled tubing hold-down assembly; (b) a tensioner frame rotatably mounting the coiled tubing tensioner wheel and a pair of tensioner frame lifting sheaves; (c) a plurality of hinged swing arms, wherein the swing arms are attached at a first end to the tensioner frame and at a second end to a trailer bed and wherein the tensioner frame is selectably moved from a first position resting the tensioner frame on the trailer bed to a second position resting a first end of the tensioner frame on a rig floor as the swing arms pivot from a first position to a second position; (d) an elevatable mast having two parallel side panels, a crown block mounted on a top end of the mast, a drawworks winch mounted on a front side of the mast, and a pair of tensioner lifting winches mounted on opposed sides of a back side of the mast; (e) a plurality of top drive lifting lines having a first end attached to the drawworks winch and a second end attached to a top drive, wherein the top drive lifting lines pass over the crown block; and (f) a pair of tensioner lifting lines, wherein each tensioner lifting line has a first end attached to one of the tensioner lifting winches and a second end attached to the top drive, wherein each tensioner lifting line has a length sufficient to be reeved through one of the tensioner frame lifting sheaves and a tensioner lift line turning sheave mounted on the top drive.

Yet another embodiment of the present invention includes a method for raising a coiled tubing tensioner from a trailer bed to a rig floor, the method including the steps of: (a) placing a trailer mounted coiled tubing tensioner positioning system in close proximity to a well head, wherein the positioning system includes (i) a coiled tubing tensioner wheel mounting a coiled tubing hold-down assembly; (ii) a tensioner frame rotatably mounting the coiled tubing tensioner wheel, a plurality of pivotable swing arms, and a pair of tensioner frame lifting sheaves; (iii) an elevatable mast mounting a crown block, a drawworks winch, and a pair of tensioner lifting winches; (iv) a rotatable coiled tubing storage reel having a length of coiled tubing wound around the storage reel; (iv) a plurality of top drive lifting lines, each line having a first end attached to the drawworks winch and a second end attached to a top drive and wherein the top drive lifting lines pass over the crown block; and (v) a pair of tensioner lifting lines, wherein each tensioner lifting line has a first end attached to one of the tensioner lifting winches and a second end attached to the top drive, wherein each tensioner lifting line is reeved through one of the tensioner frame lifting sheaves and a tensioner lift line turning sheave mounted on the top drive; (b) preventing the rotation of the tensioner by engaging the coiled tubing hold-down assembly; (c) permitting free rotation of the coiled tubing storage reel; (d) engaging the tensioner lifting winches to act on the tensioner lifting lines to pivot the swing arms into a substantially vertical position; and (e) lowering the tensioner slowly so that a front portion of the tensioner frame is resting on the rig floor.

The foregoing has outlined rather broadly several aspects of the present invention in order that the detailed description of the invention that follows may be better understood and thus is not intended to narrow or limit in any manner the appended claims which define the invention. Additional features and advantages of the invention will be described hereinafter which form the subject of the claims of the invention. It should be appreciated by those skilled in the art that the conception and the specific embodiment disclosed may be readily utilized as a basis for modifying or designing of the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 is an oblique view of the first embodiment of the present invention, wherein a connector with a male distal thread at a first end is welded at its second end to one end of a coiled tubing string.

DESCRIPTION OF THE PREFERRED EMBODIMENTS

Conventional materials such as steel, cast iron, or rubber are typically used in the production of the drilling rig described below. Welding and bolting are generally used to connect the component pieces of the various mechanisms and structural components. Bearings, for supporting rotatable or linearly reciprocable components, are preferably either steel roller bearings or solid bearings, such as porous bronze bushings.

Figure 1:
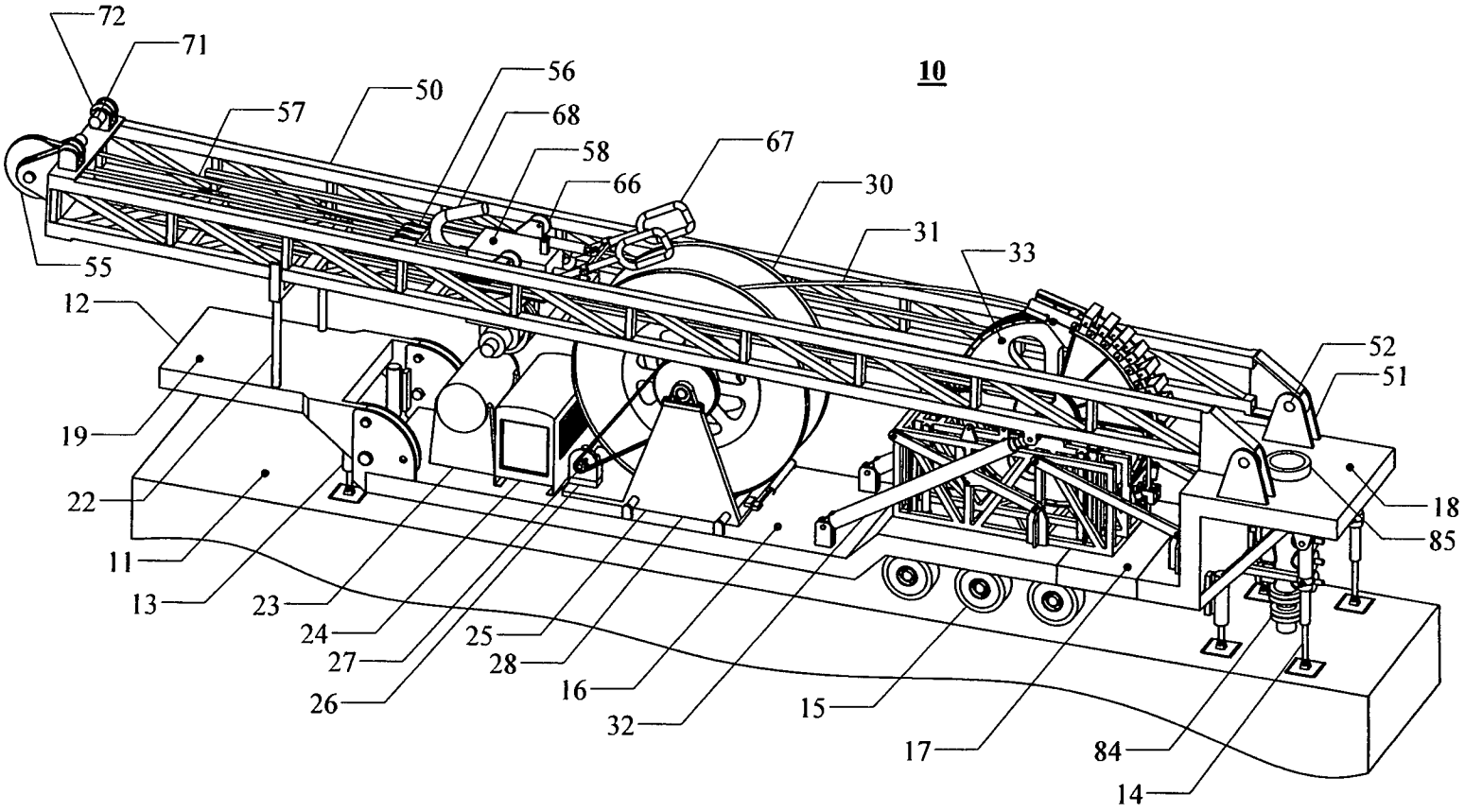
FIG. 1 is an oblique side view from above of the combination rig of the present invention, wherein the rig is stowed on a trailer preparatory to its being erected at a well location.
Figure 2:
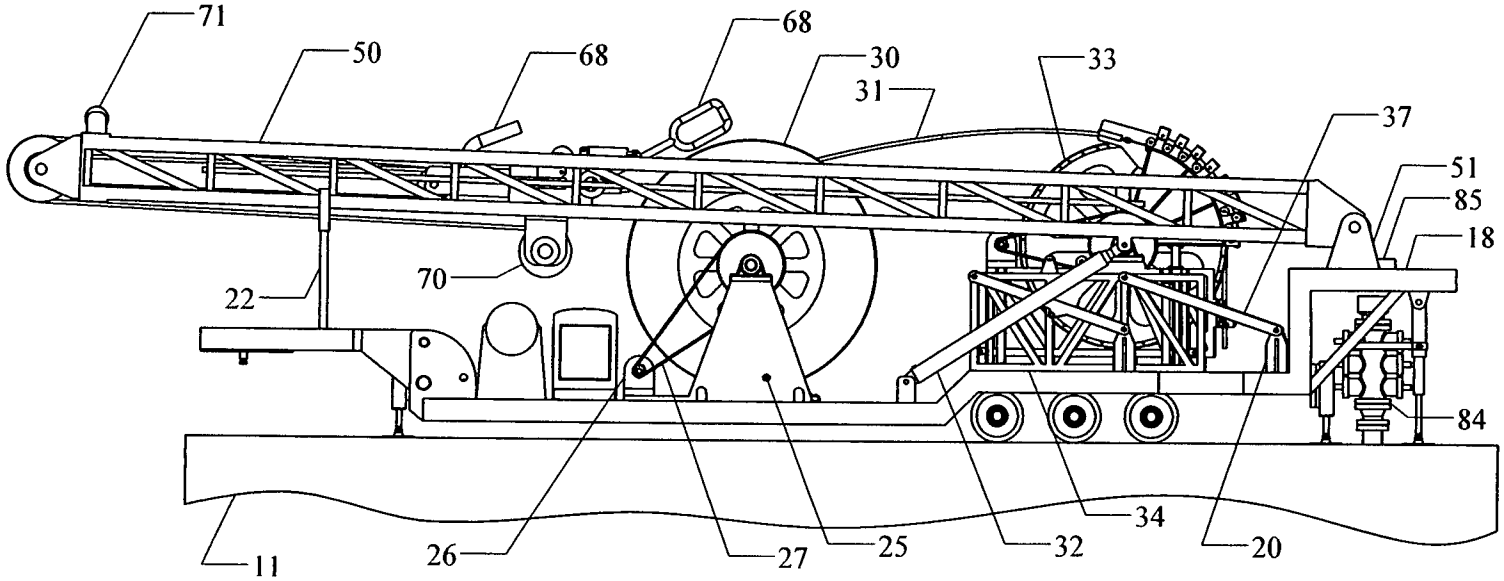
FIG. 2 is a side profile view of the combination rig corresponding to FIG. 1.

Referring to FIGS. 1 and 2, the combination drilling rig 10 of the present invention is seen in an oblique view and a side profile view, respectively. In FIGS. 1 and 2, the rig 10 is shown in position after it has been parked and stabilized in position aligned over a wellhead 84. The vehicle which has hauled the rig 10 to the well location has been detached from the rig trailer 12 which serves as a structural support for the rig. The trailer 12 is supported on the ground surface 11 by its wheels and axles 15, as well as front support jacks 13 and rear support jacks 14.

The rig 10, mounted on rig trailer 12, consists of a coiled tubing storage reel 30, a wheel type coiled tubing tensioner 33, a drilling mast 50 with a top drive 58, and operable means for positioning these components.

The rig trailer 12 has multiple substantially horizontal deck levels for mounting the rig equipment assemblies. From its forward end, the trailer 12 has a forward deck 19, a central deck 16, a tensioner deck 17, and a rig floor 18. The elevated forward deck 19 of the trailer 12 has a vertical pin which permits attachment of the trailer to a tractor rig in order to permit towing. On its upper side, a frame mast support 22 holds the drilling mast 50 when it is in its stowed position, as seen in FIGS. 1 and 2.

The central deck 16 is lower than the other decks and has selectably extendable front support jacks 13 on its forward end. The jacks 13 are extended to support the forward end of the rig trailer 12 when the trailer is disconnected from its tow tractor. From its forward end, the central deck 16 mounts a fuel tank 23, a power supply 24, the storage reel assembly for the coiled tubing 31, and two telescopic mast elevator cylinders 32. The power supply 24 typically is a diesel engine which is used to drive a hydraulic pump.

The storage reel assembly consists of a base 25, a hydraulic motor 26 having a rotatable sprocket for power output, a reel drive chain 27 engaged with the sprocket of the hydraulic motor, and a reel 30 supported by rotary bearings on the base 25. The reel 30 has a large driven sprocket engaged with the drive chain 27 on the outboard side of one of its flanges. The coiled tubing 31 is stored wound on the reel. The hydraulic motor 26 can be used to pay out or retrieve the coiled tubing 31. It can also be used to prevent reel rotation or to provide resistance to tubing payout.

The tensioner deck 17, slightly higher than the central deck 16, primarily serves to provide a storage location for the tensioner 33. The tensioner 33 has a structural space frame 34 which mounts the tensioner wheel 42, a hydraulic drive motor 38 with an output sprocket, a pair of lifting padeyes 35, a pair of lifting sheaves 36 mounted on padeyes 35, and a tubing hold down assembly 41.

The tensioner wheel 42 of tensioner 33 has a central circumferential groove on its periphery to engage tubing 31 and is supported on rotary bearings mounted on the frame 34. A driven sprocket, like the coiled tubing reel sprocket 40, is attached to the tensioner wheel 42. A drive chain 39 interconnects the sprocket attached to the drive motor 38 and provides means to selectably rotate the tensioner wheel 42 in either direction. A tubing hold down assembly 42 applies radially inward forces to tubing 31, thereby enabling the tensioner wheel 42 to apply higher tangential forces for tensioning to the tubing.

Mirror image pairs of parallel swing arms 37 are mounted on their lower ends to tensioner pivots 20 and on their upper ends to pivots on the frame 34. The tensioner pivots are mounted to the tensioner deck 17. The arrangement of the swing arms 37 is such that the tensioner 33 can be moved in an arcuate path to and from its stowed position wherein the frame 34 rests on the tensioner deck 17 to a second position wherein the frame rests on the rig floor 18.

The rig floor 18 at the rear of the trailer 12 is elevated above the other levels of the trailer in order to permit it to clear a wellhead 84 with blowout preventers mounted thereon. The rig floor 18 is supported by a knee brace at all times and also has multiple selectably extendable rear support jacks 14 to provide structural support and rigidity necessary for rig operations. A slip bowl 85 to accommodate pipe slips (not shown) is centrally mounted in the center of the rig floor 18. The rig floor 18 also mounts a pair of laterally spaced apart mast support brackets 51.

Figure 7:
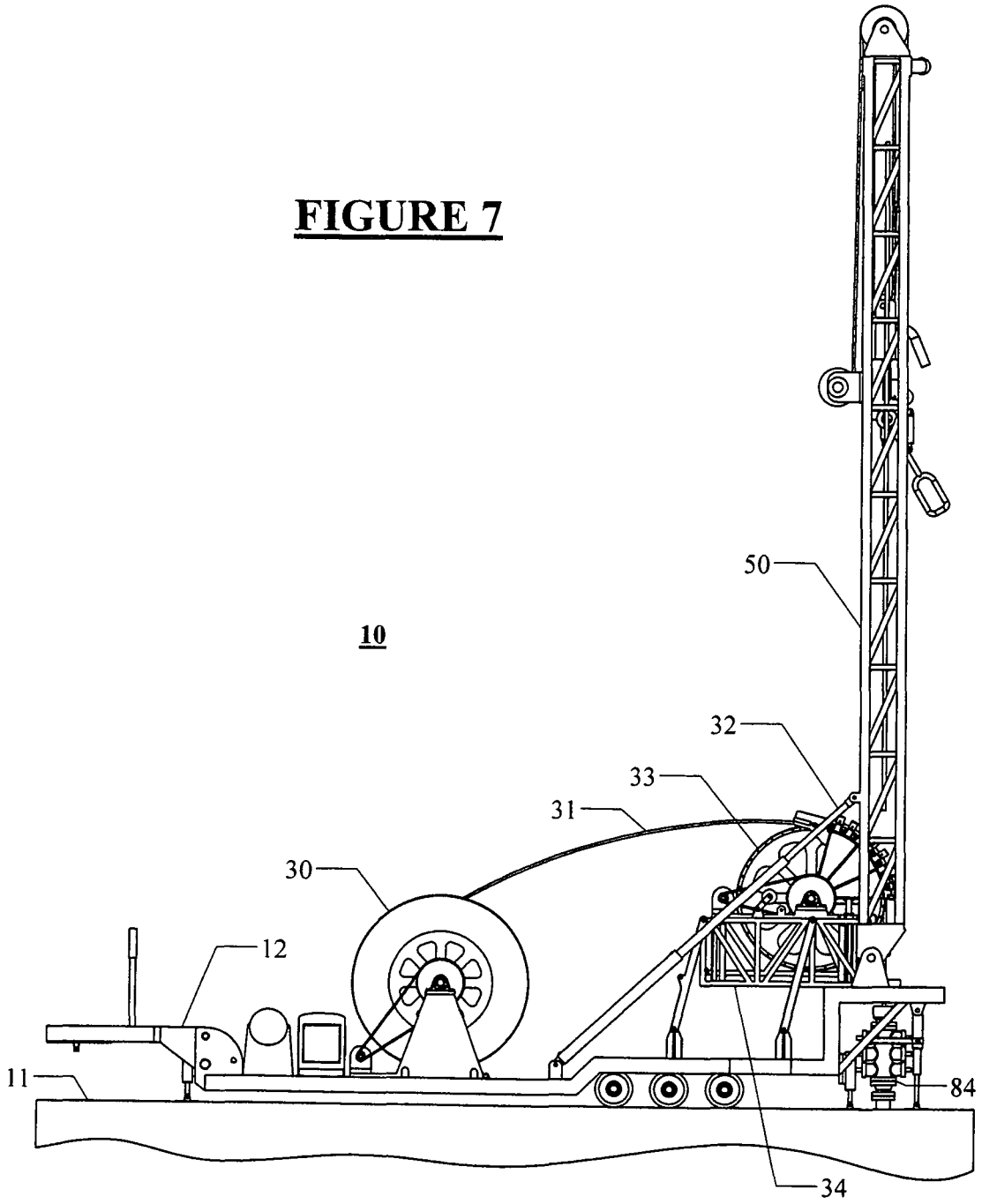
FIG. 7 is a side profile view of the coiled tubing tensioner emplaced on the rig floor in order to permit its use for downhole operations, such as drilling.
Figure 8:
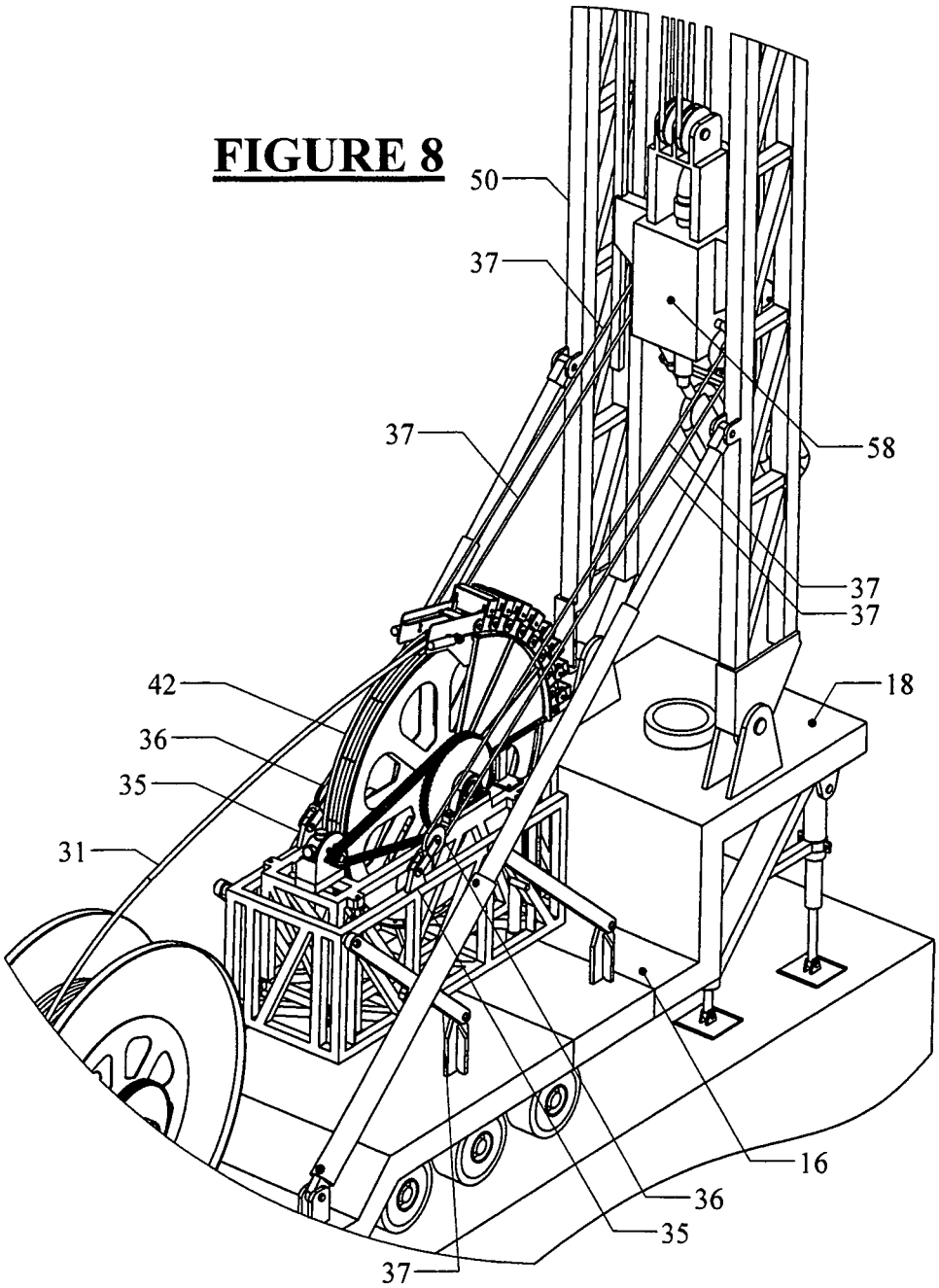
FIG. 8 is a detailed view of the lifting lines and top drive from FIG. 5. The view of FIG. 8 is taken within the Circle 8 of FIG. 6.

The drilling mast 50 of the rig is an elongated space truss having parallel sides and a rectangular cross section. At its lower end, the mast 50 has a pair of pin plates each of which has its horizontal pin hole engaged by a mast pivot pin 52 which is also engaged in corresponding holes in the mast support brackets 51. The lower portion of the mast 50 has its chords braced in the fore-aft plane, but not in the transverse plane. This is necessary in order to permit clearance for drill pipe and casing handling, as well as clearance for the storage reel base 25 and the tensioner 33 when the mast 50 is stowed for transportation, as seen in FIGS. 1 and 2, and for a front portion of the tensioner frame 34 and the tensioner 33 when the tensioner 33 is lifted to rest on the rig floor 18, as seen in FIG. 7.

In addition, the rectangular interior space between the chords of the mast 50 does not contain bracing between the chords, thereby permitting free movement of a cable supported top drive 58 in that space. Longitudinally extending guide rails are placed in the interior of the rectangle formed by the mast truss chords for guidance of the top drive 58 as it moves up and down within the erected mast.

The mast 50 is provided with a crown block 55, a traveling block 56 to which the top drive 58 is attached, and multipart top drive lifting lines 57 which are paid out or retrieved by a drawworks winch 70 mounted on the mast. When the mast 50 is stowed on the mast support 22, the drawworks winch 70 is on the lower side of the mast located at approximately midlength.

The upper end of the top drive 58 is attached to the traveling block 56. At approximately midheight of the top drive on each of the vertical faces perpendicular to the side of the mast 50 on which the drawworks winch 70 is attached, the top drive mounts a tensioner lift line turning sheave 66. The top drive 58 also pivotably mounts a bail 67 on each of the same faces upon which the turning sheaves 66 are mounted. The bails 67 are tied together by a cross bar and can be pivoted to and from a position parallel to the axis of the mast 50.

Typically, the mast 50 is elevated above the rig floor so that the top drive 58 is positioned over the slip bowl 85, or close by. The top drive 58 has a through flow spindle tube on its central axis which is parallel to the mast 50 centerline. A gooseneck 68 provides a connection to a high pressure drilling mud delivery hose (not shown) and a fluid swivel attached to the spindle tube through the top drive 58. The lower end of the spindle tube is threaded for fluid tight connection to the rotatable drillstring or a casing (not shown) in order to permit both manipulation of and flow circulation through any attached tubular goods. Typically, the mast is lifted above the rig so that At the upper end of the mast 50, a pair of laterally spaced apart tensioner lifting winches 71, each driven by a tensioner lifting winch motor 72, are located on the side of the mast opposed to the drawworks winch 70. Each tensioner lifting winch 71 deploys and manipulates a tensioner lifting line 73 which passes down the side of the mast 50. When the tensioner lifting winches 71 are to be used for raising or lowering the tensioner 33, the end of each tensioner lifting line 73 is passed through its respective lifting sheave 66 and then doubled back to be anchored to the body of the top drive 58. FIGS. 4, 5, 6, 8, and 9 show the arrangement of the tensioner lifting lines 73 for the raising or lowering of the tensioner 33.

OPERATION OF THE INVENTION

Figure 3:
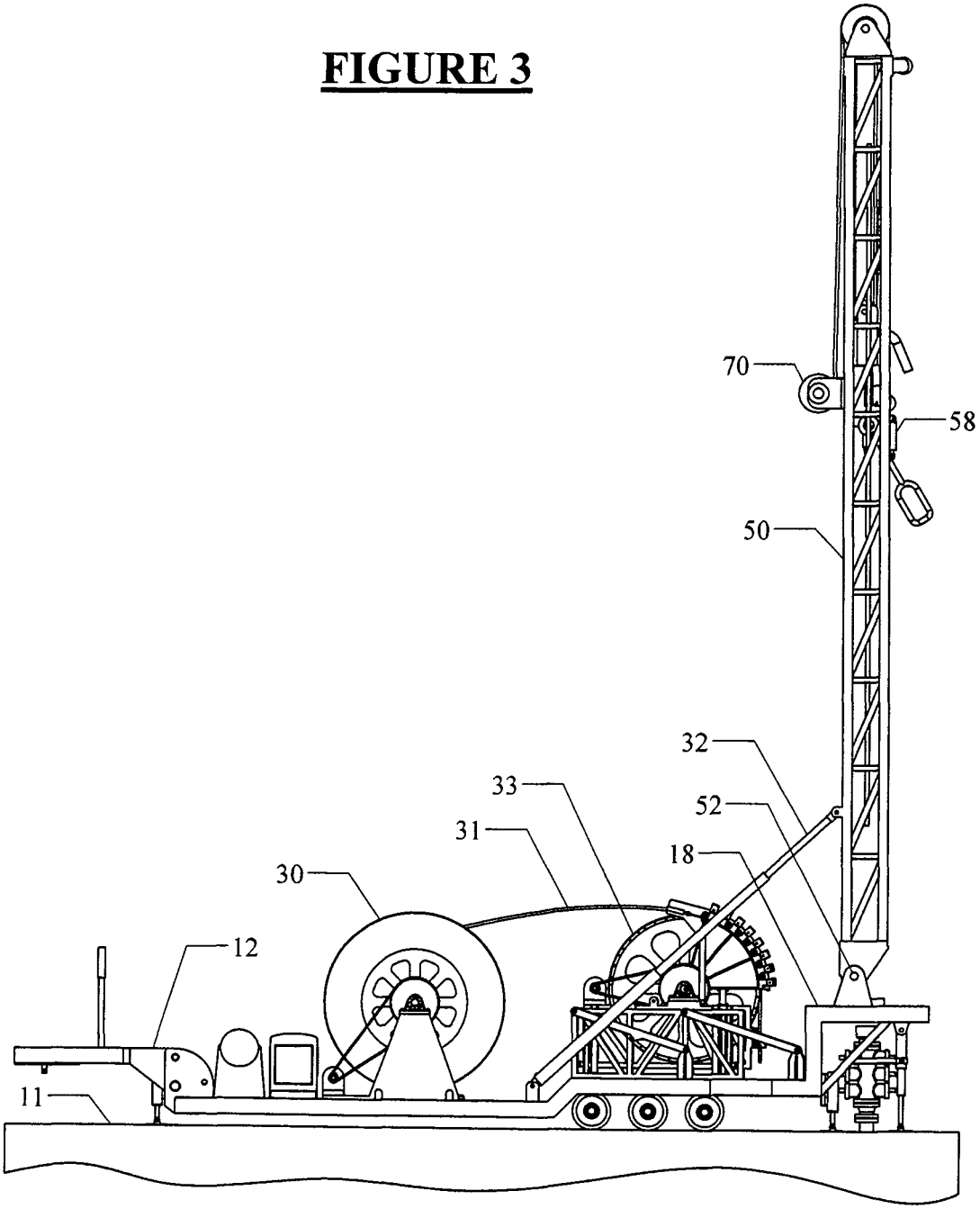
FIG. 3 is a side profile view of the combination rig, wherein the mast is elevated to permit standard rotary drilling operations or, alternatively, for use in raising the coiled tubing tensioner up to the rig floor.

FIGS. 1 and 2 show the combination rig 10 of the present invention when it is positioned at a wellhead 84 preparatory to beginning operations. The large mast elevator cylinders 32 are extended to elevate the mast 50 to its vertical working position with the top drive 58 spindle coaxial with the slip bowl 85 and the wellhead 84, as shown in FIG. 3. A pipe ramp trailer (not shown) is used when conventionally drilling with drill pipe or when running casing. In such a case, the pipe ramp trailer would be abutting the rig floor on the side opposed to the tubing storage reel 25. During these operations, the combination rig 10 functions in the same manner as a conventional rotary drilling rig, and the tensioner 33 remains stowed on the tensioner deck 17 of the rig trailer 12.

When it is desired to use the combination rig 10 for coiled tubing operations in a well, it is necessary to raise the tensioner 33 up onto the rig floor 18. This is done in the following manner. First, the free ends of the tensioner lifting lines 73 are slackened and reeved through the lifting sheaves 36 on the frame 34 of the tensioner 33 and then are brought back to be anchored on the body of the top drive 58. The top drive 58 is lowered to a first position that is approximately midheight between the drawworks winch 70 and the rig floor 18.

Following rigging of the tensioner lifting lines, the tensioner 33 is used to clamp the pipe and the tensioner drive motor is locked to prevent rotation of the tensioner. Then the storage reel is permitted to free wheel while the tensioner lifting winches 71 reel in the tensioner lifting lines 73. During this tensioner lifting operation, the swing arms 37 pivot and remain parallel, while the tensioner 33 remains level. The force to lift the tensioner 33 is provided entirely by the tensioner lifting winches 71 acting on the tensioner lifting lines 73 until the swing arms attain or slightly pass a vertical condition.

Slightly before the swing arms 37 become vertical, the payout of the coiled tubing 31 on the storage reel 25 is retarded by braking provided by the reel hydraulic motor 26. The weight of the tensioner 33 then urges the tensioner downwardly, while the braking of the reel producing tension in the tubing 31 controls the gradual lowering of the tensioner to the rig floor 18.

When resting on the rig floor 18, the tensioner 33 is positioned as shown in FIG. 7. The front part of the tensioner 33 rests on the rig floor 18 with the end of the coiled tubing generally aligned with the slip bowl 85 and under the top drive 58. At this point, coiled tubing operations such as perforation washing, downhole tool running and retrieval, and drilling with a downhole motor can be performed.

The lowering of the tensioner 33 back to its stowed position proceeds as follows. All tubing is removed from the well. Then the tensioner lifting lines 73 are reeved through the lifting sheaves 36 and anchored to the top drive 58 in the same manner as preparatory to lifting the tensioner 33 to the rig floor 18. The drive motor 38 of the tensioner 33 is used to reclamp the coiled tubing 31 so that the tubing cannot move in the tensioner.

Figure 4:
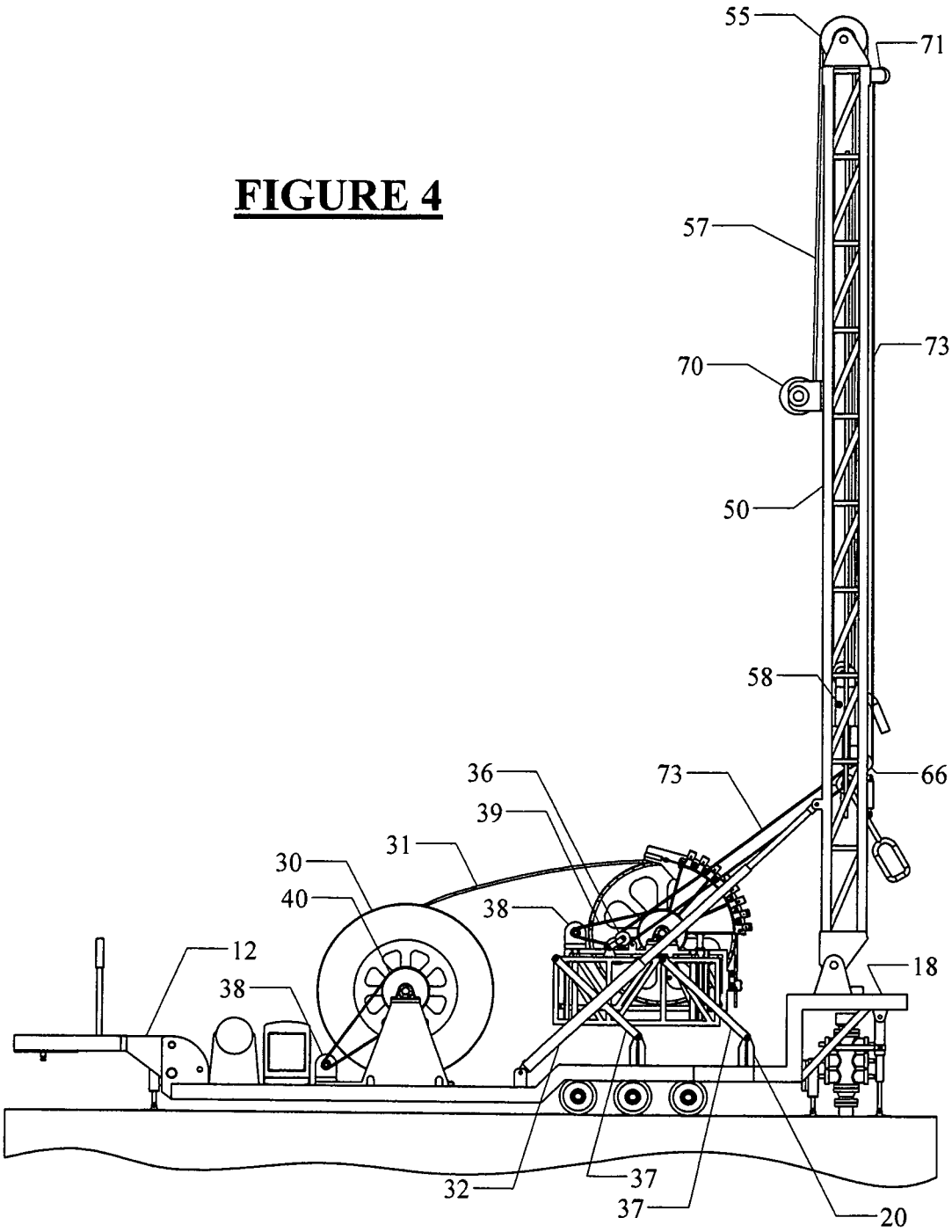
FIG. 4 is a side profile view showing the coiled tubing tensioner in an intermediate position during either its raising to or its lowering from the rig floor.
Figure 5:
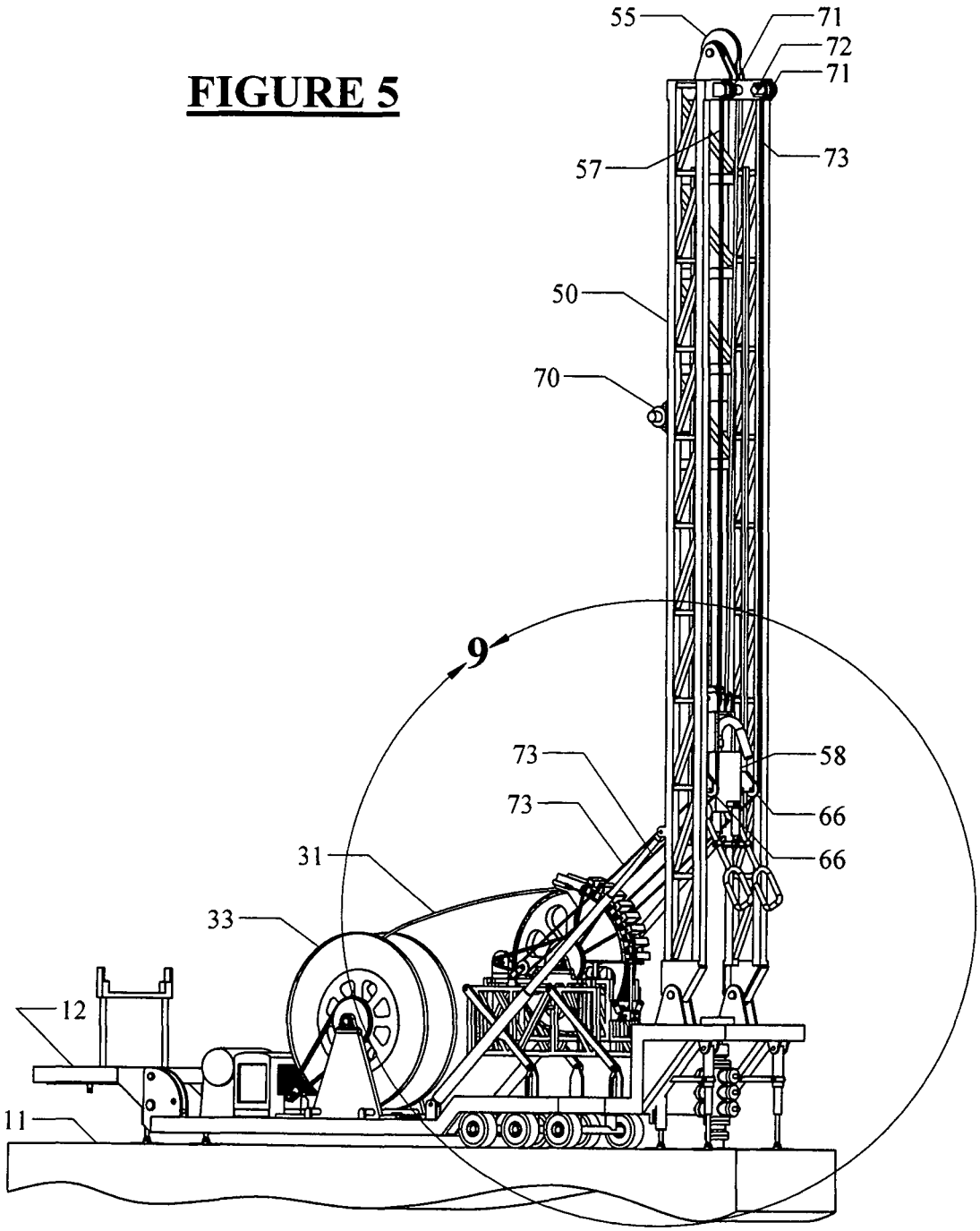
FIG. 5 is an oblique view of the combination rig with the tensioner in the intermediate position of FIG. 4. The view of FIG. 5 shows the deployment of the lifting lines used in the raising and lowering of the tensioner from the side of the mast opposed to the reel.
Figure 6:
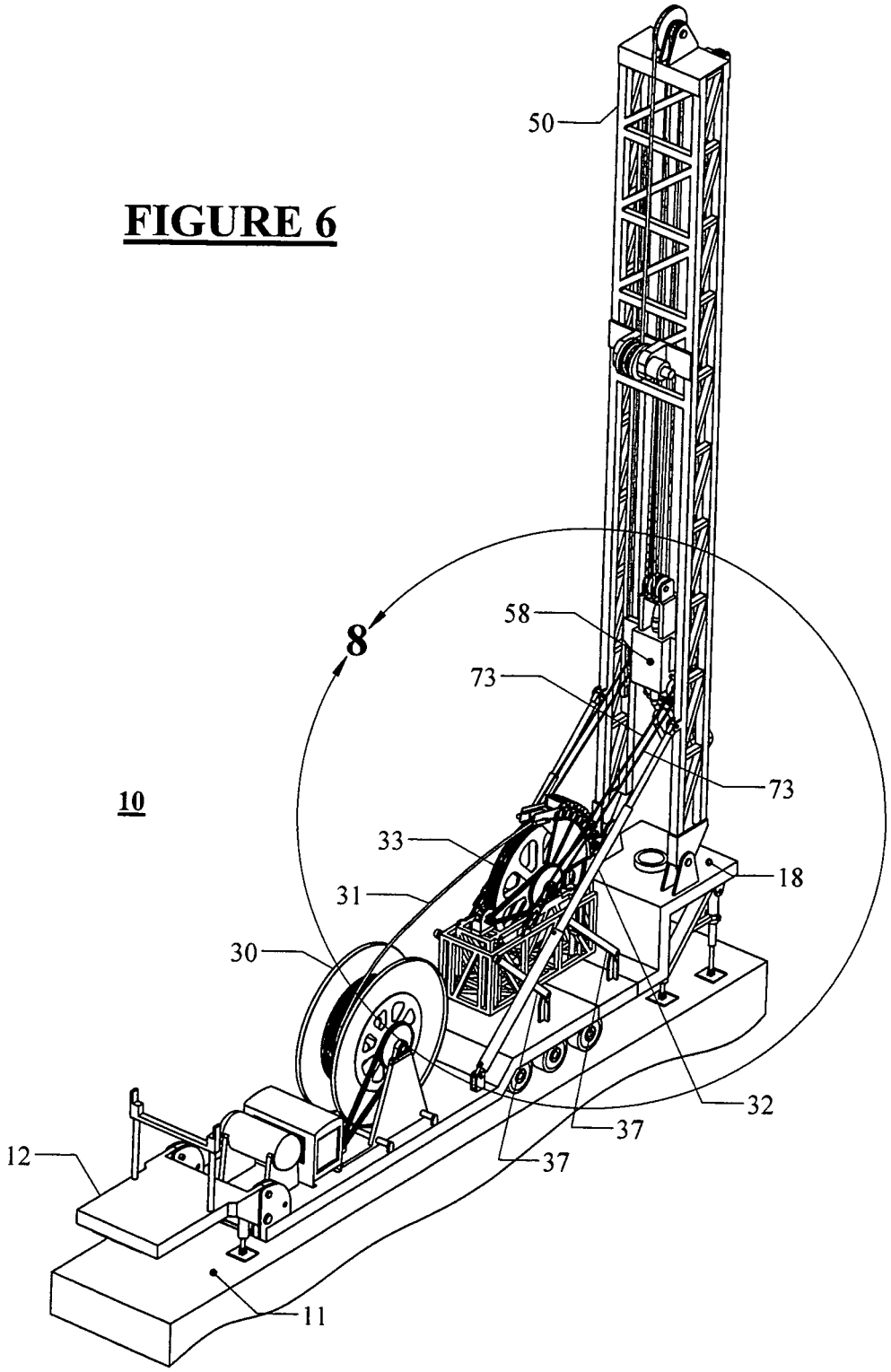
FIG. 6 is an oblique view corresponding to the position of the tensioner in FIGS. 4 and 5. The view in FIG. 6 is taken from the reel side of the mast.
Figure 9:
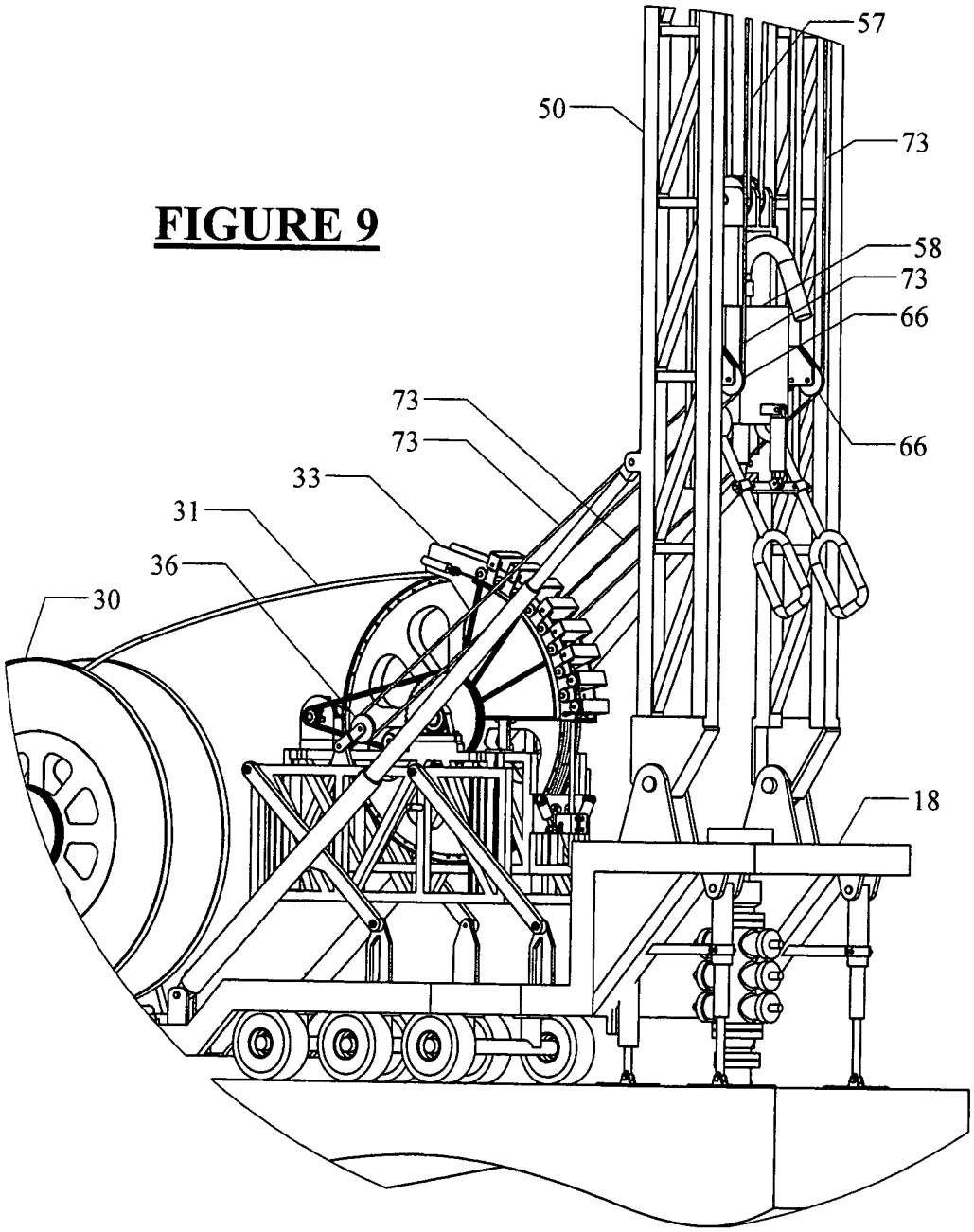
FIG. 9 is a detailed view of the lifting lines from FIG. 5. The view of FIG. 9 is taken within the Circle 9 of FIG. 5.
Figure 10:
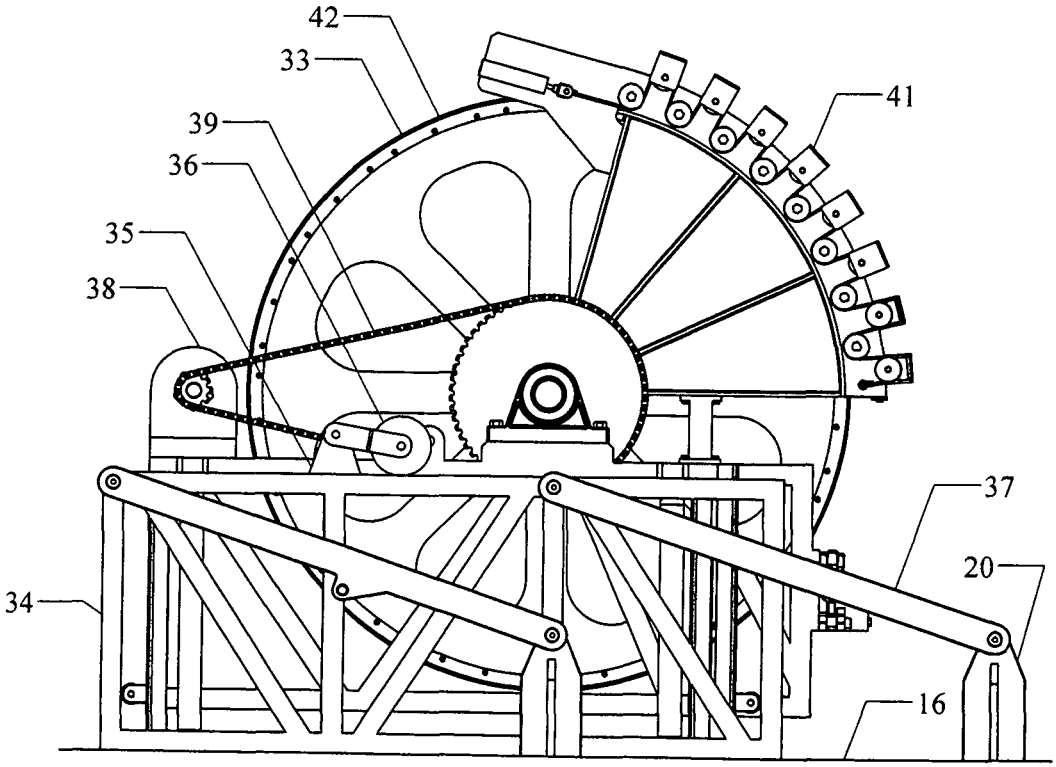
FIG. 10 is a side profile view of the tensioner assembly in its stowed position on the central deck of the trailer.

The hydraulic motor 26 of the reel assembly is then engaged to pull the tensioner 33 towards the reel. The tensioner lifting winches 71 merely provide sufficient tension to keep the tensioner lifting lines 73 from fouling until the swing arms become nearly vertical. The tensioner lifting winches 71 are then caused to more actively resist payout of the tensioner lifting lines 73. Following this, the hydraulic motor 26 of the coiled tubing storage reel assembly is used to pull the tensioner towards its stowed position on the tensioner deck 17 of the trailer. FIGS. 4 and 9 show the configuration of the partially lowered tensioner 33. Except for curvature of the tubing 31 between the reel 30 and the tensioner 33, the appearance of the reel assembly 25, the tubing 31, and the tensioner 33 and lifting lines is substantially the same for both raising and lowering of the tensioner.

The present invention offers a low cost, safe, easily controlled means for reversibly emplacing and removing a wheel type coiled tensioner from the rig floor of a truck mounted combination drilling rig.

It is operationally much more convenient to have an integral, rapidly operable means for both transferring and operating the coiled tubing tensioner 33 either in its conventional position on the rear deck of the rig trailer or on the rig floor of a drilling rig. This saves operating time when the tensioner is to be transferred to and from a drilling rig floor and may avoid the need for providing a separate lifting means such as a crane or large forklift truck to effect the transfer. The transfer between the trailer and the drilling rig floor is easily accomplished with the self-contained lifting system shown in FIGS. 7-9.

Although the present invention has been described in detail, it should be understood that various changes, substitutions and alterations can be made herein without departing from the spirit and scope of the invention as defined by the appended claims. As may be understood readily by those skilled in the art, certain variations in the structure of the present invention may be made without departing from the spirit of the invention.

What is claimed is:

1. A system for positioning a coiled tubing tensioner, the system comprising:

(a) a coiled tubing tensioner wheel mounting a coiled tubing hold-down assembly;

(b) a tensioner frame rotatably mounting the coiled tubing tensioner wheel, a plurality of pivotable swing arms, and a pair of tensioner frame lifting sheaves;

(c) an elevatable mast mounting a crown block, a drawworks winch, and a pair of tensioner lifting winches;

(d) a plurality of top drive lifting lines, each line having a first end attached to the drawworks winch and a second end attached to a top drive and wherein the top drive lifting lines pass over the crown block; and (e) a pair of tensioner lifting lines, wherein each tensioner lifting line has a first end attached to one of the tensioner lifting winches and a second end attached to the top drive, wherein each tensioner lifting line has a length sufficient to be reeved through one of the tensioner frame lifting sheaves and a tensioner lift line turning sheave mounted on the top drive.

2. The system of claim 1, wherein the top drive pivotably mounts a pair of connected bails that pivot between a first position parallel to the axis of the mast and a second position that is not parallel to the axis of the mast.

3. The system of claim 1, wherein the top drive has a through flow spindle tube passing through a central axis of the top drive.

4. The system of claim 3, wherein the spindle tube is coaxial with a slip barrel in the rig floor whenever the mast is elevated.

5. The system of claim 1, wherein each swing arm is attached at one end to the tensioner frame and at a second end to a trailer.

6. The system of claim 5, wherein the swing arms are parallel to each other.

7. The system of claim 6, wherein the swing arms remain parallel to each other as the swing arms are pivoted.

8. The system of claim 7, wherein a bottom side of the tensioner frame is parallel to the trailer.

9. The system of claim 1, wherein the mast has two parallel sides such that when the mast is elevated the two parallel sides are positioned over opposed sides of a rig floor.

10. The system of claim 9, wherein pivoting the swing arm positions the tensioner frame between a first position on a trailer bed and a second position having a portion of the tensioner frame resting on the rig floor between the two parallel sides of the mast.

11. The system of claim 1, wherein the top drive is attached to a traveling block.

12. A system for positioning a coiled tubing tensioner, the system comprising:

(a) a coiled tubing tensioner wheel mounting a coiled tubing hold-down assembly;

(b) a tensioner frame rotatably mounting the coiled tubing tensioner wheel and a pair of tensioner frame lifting sheaves;

(c) a plurality of hinged swing arms, wherein the swing arms are attached at a first end to the tensioner frame and at a second end to a trailer bed and wherein the tensioner frame is selectably moved from a first position resting the tensioner frame on the trailer bed to a second position resting a first end of the tensioner frame on a rig floor as the swing arms pivot from a first position to a second position;

(d) an elevatable mast having two parallel side panels, a crown block mounted on a top end of the mast, a drawworks winch mounted on a front side of the mast, and a pair of tensioner lifting winches mounted on opposed sides of a back side of the mast;

(e) a plurality of top drive lifting lines having a first end attached to the drawworks winch and a second end attached to a top drive, wherein the top drive lifting lines pass over the crown block; and (f) a pair of tensioner lifting lines, wherein each tensioner lifting line has a first end attached to one of the tensioner lifting winches and a second end attached to the top drive, wherein each tensioner lifting line has a length sufficient to be reeved through one of the tensioner frame lifting sheaves and a tensioner lift line turning sheave mounted on the top drive.

13. The system of claim 12, wherein the top drive pivotably mounts a pair of connected bails that pivot between a first position parallel to the axis of the mast and a second position that is not parallel to the axis of the mast.

14. The system of claim 12, wherein the top drive has a through flow spindle tube passing through a central axis of the top drive.

15. The system of claim 14, wherein the spindle tube is coaxial with a slip barrel in the rig floor whenever the mast is elevated.

16. The system of claim 12, wherein the swing arms remain parallel to each other as the swing arms are pivoted between the first position to the second position.

17. The system of claim 12, wherein whenever the mast is elevated the two parallel sides are positioned over opposed sides of the rig floor.

18. The system of claim 12, further including a pair of mast elevating hydraulic cylinders attached at one end to the mast and at a second opposed end to a trailer bed.

19. The system of claim 12, further including a coiled tubing reel mounted to the trailer bed.

20. The system of claim 12, wherein the positioning system is mounted on the trailer bed.

21. A method for raising a coiled tubing tensioner from a trailer bed to a rig floor, the method including the steps of:

(a) placing a trailer mounted coiled tubing tensioner positioning system in close proximity to a well head, wherein the positioning system includes (i) a coiled tubing tensioner wheel mounting a coiled tubing hold-down assembly;

(ii) a tensioner frame rotatably mounting the coiled tubing tensioner wheel, a plurality of pivotable swing arms, and a pair of tensioner frame lifting sheaves;

(iii) an elevatable mast mounting a crown block, a drawworks winch, and a pair of tensioner lifting winches;

(iv) a rotatable coiled tubing storage reel having a length of coiled tubing wound around the storage reel;

(iv) a plurality of top drive lifting lines, each line having a first end attached to the drawworks winch and a second end attached to a top drive and wherein the top drive lifting lines pass over the crown block; and (v) a pair of tensioner lifting lines, wherein each tensioner lifting line has a first end attached to one of the tensioner lifting winches and a second end attached to the top drive, wherein each tensioner lifting line is reeved through one of the tensioner frame lifting sheaves and a tensioner lift line turning sheave mounted on the top drive;

(b) preventing the rotation of the tensioner by engaging the coiled tubing hold-down assembly;

(c) permitting free rotation of the coiled tubing storage reel;

(d) engaging the tensioner lifting winches to act on the tensioner lifting lines to pivot the swing arms into a substantially vertical position; and (e) lowering the tensioner slowly so that a front portion of the tensioner frame is resting on the rig floor.

* * * * *